United States Patent [19]

Sotheran

[11] Patent Number: 4,742,684

[45] Date of Patent: May 10, 1988

[54] FUEL VAPORIZERS FOR A GAS TURBINE ENGINE COMBUSTION ENGINE

[75] Inventor: Arthur Sotheran, Bristol, England

[73] Assignee: Rolls-Royce plc, London, England

[21] Appl. No.: 660,556

[22] Filed: Oct. 15, 1984

Related U.S. Application Data

[63] Continuation of Ser. No. 445,096, Nov. 29, 1982, abandoned.

[30] Foreign Application Priority Data

Dec. 24, 1981 [GB] United Kingdom ..... 8138955

[51] Int. Cl.[4] ..... F02C 7/22

[52] U.S. Cl. ..... 60/738; 60/756

[58] Field of Search ..... 431/354; 60/734, 737, 60/738, 756

[56] References Cited

U.S. PATENT DOCUMENTS 2,956,404 10/1960 Kassner et al. .
3,626,444 12/1971 Carvel ..... 60/738
4,275,564 6/1981 Kappler et al. ..... 60/738

FOREIGN PATENT DOCUMENTS 2234589 12/1978 Fed. Rep. of Germany .
1135104 10/1965 United Kingdom .
1273017 10/1968 United Kingdom .
2004049 3/1979 United Kingdom ..... 60/738

*Primary Examiner*—Louis J. Casaregola
*Assistant Examiner*—Timothy S. Thorpe
*Attorney, Agent, or Firm*—Parkhurst & Oliff

[57] ABSTRACT

A fuel vaporizer for a gas turbine engine combustion chamber comprises a hollow cylindrical stem open at one end and branching into two radial branch ducts at the other end which terminate in outlets facing towards the inlet end. In order to ensure more even cooling of the vaporizer stem, the fuel injector which lies inside the stem has two outlets which direct fuel onto those parts of the interior wall of the stem which lie between the branch passages, and a baffle divides the interior of the stem to ensure that each branch passage is fed with fuel from only one fuel injector, and each fuel injector supplies only one branch passage.

3 Claims, 1 Drawing Sheet

FUEL VAPORIZERS FOR A GAS TURBINE ENGINE COMBUSTION ENGINE

This is a continuation of application Ser. No. 445,096 filed Nov. 29, 1982, now abandoned.

The present invention relates to fuel vaporizers for gas turbine engine combustion chambers.

Fuel vaporizers are conventionally made in a T-shape and consist of a hollow circular stem from one end of which two branch ducts extend on opposite sides, as exemplified by U.K. Patent No. 2,004,409. The branch ducts terminate in outlets which face back toward the other end of the stem. A fuel injector lies within the stem, for injecting fuel into an air flow passing through the vaporizer, and to ensure an even division of fuel between the two outlets, the fuel injector has two nozzles which supply a jet of fuel in line with each outlet.

Because the outlets face toward the inlet end of the stem, those parts of the wall of the stem in line with the outlets, are washed by relatively cold vaporized fuel on the outside wall as well as by the fuel and air on the inside wall, whereas those parts of the stem lying between the outlets are exposed to hot combustion gases. This gives rise to thermal gradients around the stem which lead to low cycle fatigue and cracking of the stem.

An object of the present invention is to provide a vaporizer in which this problem is reduced or eliminated.

According to the present invention a fuel vaporizer for a gas turbine engine combustion chamber comprises a hollow stem having an inlet at one end, a pair of branch ducts extending from opposite sides of the stem at the other end thereof and defining outlets for vaporized fuel which face towards the inlet end of the stem, a fuel injector inside the stem having two nozzles for injecting fuel into the stem wherein the two nozzles are arranged to direct fuel toward parts of the inner wall of the stem lying in between the branch ducts. Baffle means are provided which extend between the nozzles and the branch ducts and which divide the interior of the stem into two longitudinal passages each of which is arranged to receive fuel from only one of the nozzles and which communicates with only one of the branch ducts.

Examples of the invention will now be more particularly described with reference to the accompanying drawings in which.

Figure 1:
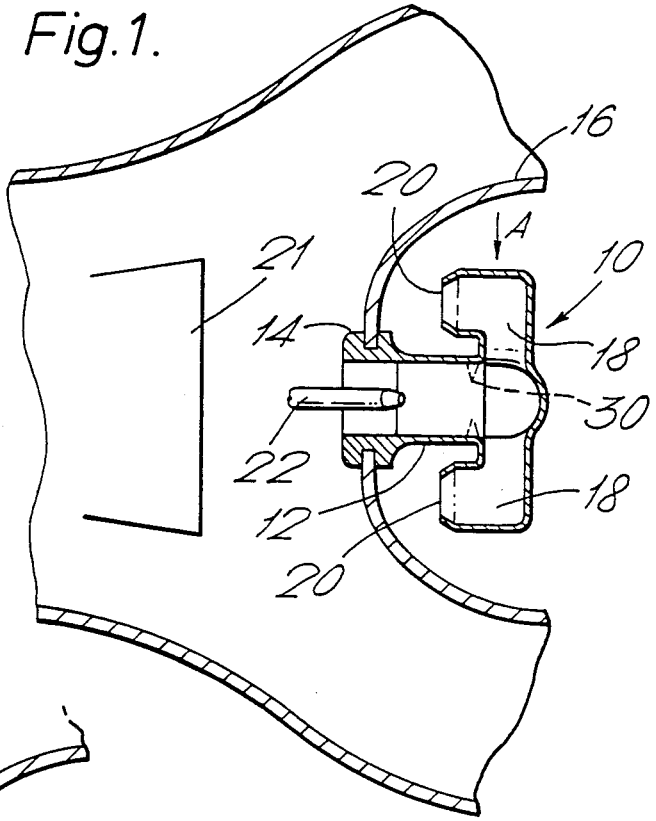
FIG. 1 shows the upstream part of a gas turbine engine combustion chamer including a vaporizer of the present invention.

Referring now to the drawings, the vaporizer 10 has a hollow cylindrical stem 12 connected at one end 14 (the inlet end) to the upstream wall of the combustion chamber 16. At the other end of the stem 12 are two radial branch ducts 18 on opposite sides thereof which terminate in upstream facing circular outlets 20.

Air from the delivery 21 of the engine compressor enters the inlet of the vaporizer stem, picks up fuel from a fuel injector 22 which projects into the vaporizer from the inlet end, and passes into the interior of the combustion chamber through the outlets 20.

It can be seen that the vaporized fuel flowing from the outlets 20 towards the upstream end of the combustion chamber passes over the parts of the outer surface of the vaporizer stem which are in line with the outlets and assists in cooling the stem. Those parts of the outer surface of the stem lying between the outlets however, are exposed to hot gases.

The air flowing through the interior of the vaporizer stem assists in cooling the vaporizer, but the fuel from the fuel injector 22 is also directed at the internal surface of the vaporizer stem for additional cooling.

Figure 2:
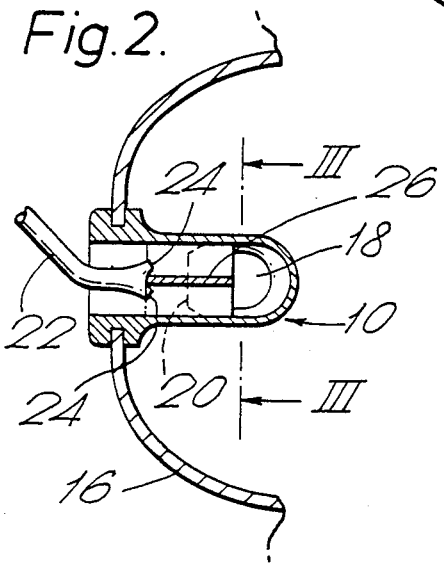
FIG. 2 is a view in the direction of arrow A in FIG. 1 of the vaporizer only.

To even out the cooling, and thereby to minimize thermal gradients around the vaporizer, the fuel injector has two nozzles 24 which spray fuel at those parts of the inner wall of the vaporizer stem which line in between the branch ducts 18. This can be seen in FIGS. 2 and 3. However, to ensure that the fuel is evenly divided between the two branch passages, a baffle 26 is provided which extends from the nozzles 24 to the branch ducts 18.

Figure 3:
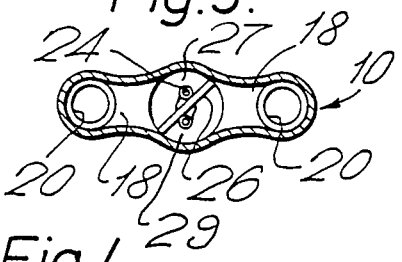
FIG. 3 is a section on the line III—III of FIG. 2.

As can be seen from FIG. 3 the baffle is arranged diagonally across the vaporizer stem to divide the interior into two longitudinal passsages 27,29, each positioned to receive fuel from one only of the nozzles, and each communicating with one only of the branch ducts.

By this means a more even cooling of the vaporizer stem can be achieved without disturbing the even distribution of the fuel between the two outlets.

Although described as having a cylindrical stem, radial branch ducts and circular outlets, clearly the shapes and dispositions of these parts of the vaporizer may be varied as desired without departing from the scope of the invention.

Figure 4:
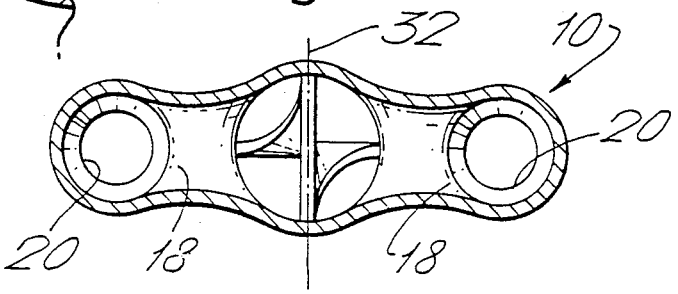
FIG. 4 is a section similar to FIG. 3 but of an alternative embodiment of the invention.

In conventional vaporizers a weir is often provided, as shown in dotted lines at 30 in FIG. 1, to improve cooling of the walls of the branch ducts on the inside of the bend. To enable these weirs to be provided with the present proposal, the baffle may be of twisted form, seen in FIG. 4, so that adjacent the two nozzles it lies across the vaporizer stem at right angles to a line 32 passing through the two nozzles, but adjacent the branch ducts it lies across the vapouriser stem in line with the line 32.

I claim:

1. A fuel vaporizer for a gas turbine engine, comprising:

(a) a hollow cylindrical stem having a first end and a second end, said first end defining an inlet and being connected to an upstream wall of a combustion chamber, said second end being closed, said hollow cylindrical stem defining a longitudinal axis;

(b) a first and second branch duct extending along a second axis transverse to said longitudinal axis in diametrically opposite directions at the second end of said hollow cylindrical stem, each said branch duct defining an outlet facing toward the first end of said hollow cylindrical stem;

(c) a fuel injector located within said hollow cylindrical stem having a first and second nozzle for injecting fuel into the hollow cylindrical stem, said nozzles being spaced apart along a third axis substantially perpendicular to both said longitudinal axis and said second axis, said nozzles directing fuel toward an inner wall of the hollow stem; and (d) baffle means for ensuring substantially equal distribution of said injected fuel to said first and second branch ducts, respectively.

2. A fuel vaporizer as in claim 1, wherein said baffle means are located along a plane between a first plane defined by said longitudinal axis and said second axis, and a second plane defined by said longitudinal axis and said third axis.

3. A fuel vaporizer as in claim 1, wherein said baffle means comprise a twisted element having a first end and a second end, said first end being substantially adjacent said nozzles and being located substantially along said second axis, said second end being substantially adjacent said branch ducts and being located substantially along said third axis.

* * * * *